US010309339B2

(12) United States Patent
Kimura et al.

(10) Patent No.: US 10,309,339 B2
(45) Date of Patent: Jun. 4, 2019

(54) INTERNAL COMBUSTION ENGINE

(71) Applicant: NISSAN MOTOR CO., LTD., Yokohama-shi, Kanagawa (JP)

(72) Inventors: Yoshiyasu Kimura, Kanagawa (JP); Takao Ito, Kanagawa (JP); Nobuhiko Sato, Kanagawa (JP); Tadatoshi Miyano, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 15/574,999

(22) PCT Filed: May 25, 2015

(86) PCT No.: PCT/JP2015/002626

§ 371 (c)(1),
(2) Date: Nov. 17, 2017

(87) PCT Pub. No.: WO2016/189567

PCT Pub. Date: Dec. 1, 2016

(65) Prior Publication Data

US 2018/0135555 A1 May 17, 2018

(51) Int. Cl.
*F02F 1/42* (2006.01)
*F02F 1/24* (2006.01)
(Continued)

(52) U.S. Cl.
CPC ..... *F02F 1/42* (2013.01); *F01L 1/04* (2013.01); *F01L 1/053* (2013.01); *F01L 1/26* (2013.01);
(Continued)

(58) Field of Classification Search
CPC .... F02F 1/42; F02F 1/002; F02F 1/242; F02F 1/24; F02F 2001/244; F01L 1/26;
(Continued)

(56) References Cited

U.S. PATENT DOCUMENTS 4,534,325 A * 8/1985 Tanaka ..... F01L 1/0532 123/195 A
4,572,117 A * 2/1986 Yoshikawa ..... F02F 1/4221 123/188.17
(Continued)

FOREIGN PATENT DOCUMENTS

GB 768684 A 2/1957
JP H05-187307 A 7/1993
(Continued)

*Primary Examiner* — Hung Q Nguyen
(74) *Attorney, Agent, or Firm* — Drinker Biddle & Reath LLP

(57) ABSTRACT

An internal combustion engine including: a cylinder block in which a plurality of cylinders are formed; and a cylinder head formed in conjunction with the cylinder block into one body to form a plurality of combustion chambers, wherein an upper surface of the cylinder head is divided, along a direction in which the plurality of cylinders are arranged, into first regions that are regions that overlap the combustion chambers as viewed from an axial direction of the cylinders and a second region that is a region located between two of the first regions adjacent to each other, and at least either an intake-side cam journal or an exhaust-side cam journal is disposed in the second region.

7 Claims, 9 Drawing Sheets

(51) Int. Cl.

| | |
|---|---|
| ***F01L 1/04*** | (2006.01) |
| ***F02F 1/00*** | (2006.01) |
| ***F01L 1/053*** | (2006.01) |
| ***F01L 1/26*** | (2006.01) |
| *F01L 1/047* | (2006.01) |

(52) U.S. Cl.
CPC ..... *F02F 1/002* (2013.01); *F02F 1/24* (2013.01); *F02F 1/242* (2013.01); *F01L 2001/0476* (2013.01); *F01L 2001/0537* (2013.01); *F02F 2001/244* (2013.01)

(58) Field of Classification Search
CPC ..... F01L 1/053; F01L 1/04; F01L 2001/0537; F01L 2001/0476
See application file for complete search history.

(56) References Cited

U.S. PATENT DOCUMENTS 4,592,314 A * 6/1986 Tsuchida ..... F01L 1/053 123/90.27
4,593,657 A * 6/1986 Aoi ..... F01L 1/0532 123/193.5
4,612,885 A * 9/1986 Yoshikawa ..... F01L 1/0532 123/193.3
4,621,597 A * 11/1986 Kawada ..... F01L 1/04 123/193.5
4,709,667 A * 12/1987 Ichihara ..... F01L 1/053 123/90.27
4,823,747 A * 4/1989 Wagner ..... F01L 1/0532 123/193.5
4,836,171 A * 6/1989 Melde-Tuczai ..... F01L 1/053 123/508
4,909,195 A * 3/1990 Hasebe ..... F01L 1/26 123/90.16
4,951,622 A * 8/1990 Takahashi ..... F01M 9/10 123/193.5
4,957,079 A * 9/1990 Nakatani ..... F01L 1/0532 123/196 M
5,080,057 A * 1/1992 Batzill ..... F01L 1/053 123/193.5
5,099,812 A * 3/1992 Yamada ..... F01L 1/24 123/315
5,119,776 A * 6/1992 Bakker ..... F01L 1/0532 123/193.5
5,148,782 A * 9/1992 Kramer ..... F02F 1/002 123/195 R
5,213,071 A * 5/1993 Iwata ..... F01L 1/0532 123/193.5
5,535,714 A * 7/1996 Aoyama ..... F02B 75/22 123/193.5
5,778,841 A * 7/1998 Reedy ..... F01L 1/053 123/90.34
6,024,063 A * 2/2000 Muter ..... F01L 1/46 123/90.27
6,062,195 A * 5/2000 Tanaka ..... F02B 23/104 123/305
6,148,787 A * 11/2000 Takano ..... F01L 1/0532 123/195 A
6,276,320 B1 * 8/2001 Fujii ..... F01L 1/0532 123/90.16
6,279,529 B1 * 8/2001 Komatsu ..... F01L 1/0532 123/193.5
6,971,365 B1 * 12/2005 Najt ..... F02B 23/101 123/260
8,656,877 B2 * 2/2014 Hiramatsu ..... F01L 1/0532 123/90.27
2001/0003281 A1 * 6/2001 Mori ..... F02B 23/101 123/305
2002/0134341 A1 * 9/2002 Uchida ..... F02F 1/242 123/193.5
2002/0157629 A1 * 10/2002 Inagaki ..... F02F 1/242 123/169 PA
2003/0094155 A1 * 5/2003 Shimoyama ..... F01L 1/053 123/188.2
2003/0164151 A1 * 9/2003 Kashiwagura ..... F02D 37/02 123/295
2003/0213453 A1 * 11/2003 Matsuda ..... F02F 1/242 123/169 PA
2004/0118370 A1 * 6/2004 Ohsawa ..... F01L 1/022 123/90.16
2004/0123591 A1 * 7/2004 Yoshida ..... F01N 3/34 60/305
2004/0149267 A1 * 8/2004 Takahashi ..... F01L 1/053 123/469
2004/0190807 A1 * 9/2004 Iijima ..... F01L 1/0532 384/462
2004/0200445 A1 * 10/2004 Tsukui ..... F01L 1/022 123/58.1
2005/0247278 A1 * 11/2005 Koshimizu ..... F01L 1/022 123/90.16
2006/0266315 A1 * 11/2006 Hamada ..... F01L 1/053 123/90.16
2007/0240671 A1 * 10/2007 Imazato ..... F01L 1/053 123/193.5
2008/0087246 A1 * 4/2008 Matsuda ..... F01L 1/022 123/196 M
2009/0084340 A1 * 4/2009 Komura ..... F02F 1/24 123/193.5
2009/0084341 A1 4/2009 Komura et al.
2013/0133601 A1 * 5/2013 Maruyama ..... F01L 1/18 123/90.44
2014/0305397 A1 * 10/2014 Yanase ..... F01L 1/053 123/193.3

FOREIGN PATENT DOCUMENTS

| | | | |
|---|---|---|---|
| JP | 2003-227338 | A | 8/2003 |
| JP | 2009-85025 | A | 4/2009 |
| JP | 2009-275674 | A | 11/2009 |
| JP | 2013-130187 | A | 7/2013 |
| WO | WO 95/08057 | A1 | 3/1995 |

* cited by examiner

INTERNAL COMBUSTION ENGINE

TECHNICAL FIELD

The present invention relates to a structure of an internal combustion engine.

BACKGROUND ART

Internal combustion engines include, for example, an internal combustion engine having a head-block separation structure, as described in PTL 1. The head-block separation structure is a structure in which a cylinder block that forms cylinders and a cylinder head that forms combustion chambers in conjunction with the cylinder block are formed by casting separately and are joined to each other by cylinder head bolts.

CITATION LIST

Patent Literature

PTL 1: JP 5-187307 A

SUMMARY OF INVENTION

Technical Problem

However, in an internal combustion engine with the head-block separation structure as described in the above-described PTL 1, strength and the like required for the internal combustion engine restrict positions where cylinder head bolts are to be secured to positions where interference with the combustion chambers can be avoided. For this reason, positions where cam journals that support a cam shaft in a rotatable manner are disposed are influenced by positions where the cylinder head bolts are secured, which may cause a problem in that a degree of freedom in designing the cylinder head and cylinder block is reduced.

The present invention has been made in view of the problem as described above, and an object of the present invention is to provide an internal combustion engine that is capable of improving a degree of freedom in designing a cylinder head and cylinder block.

Solution to Problem

In order to achieve the object mentioned above, according to one aspect of the present invention, there is provided an internal combustion engine in which a cylinder block and a cylinder head are formed into one body and an upper surface of the cylinder head is divided, along a direction in which a plurality of cylinders are arranged, into first regions and a second region. Furthermore, the plurality of cylinders are formed in the cylinder block, and the cylinder block and the cylinder head form a plurality of combustion chambers. In addition, at least either an intake-side cam journal or an exhaust-side cam journal included in the cylinder head is disposed in the second region.

The first regions are regions that overlap the combustion chambers as viewed from an axial direction of the cylinders. The second region is a region located between two of the first regions adjacent to each other. The intake-side cam journal supports, in a rotatable manner, an intake-side camshaft that displaces intake valves that open and close intake passages. The exhaust-side cam journal supports, in a rotatable manner, an exhaust-side camshaft that displaces exhaust valves that open and close exhaust passages

DESCRIPTION OF EMBODIMENTS

In detailed description below, to provide full understanding of the embodiments of the present invention, specific details are described. However, it is obviously possible to implement one or more embodiments without such specific details. Moreover, to simplify the drawings, known structures and devices are sometimes illustrated schematically.

First Embodiment

A first embodiment of the present invention will be described below with reference to the drawings.

(Schematic Configuration of Vehicle)

Using FIG. 1, a schematic configuration of a vehicle including an internal combustion engine (engine) 1 of the first embodiment will be described.

Figure 1:
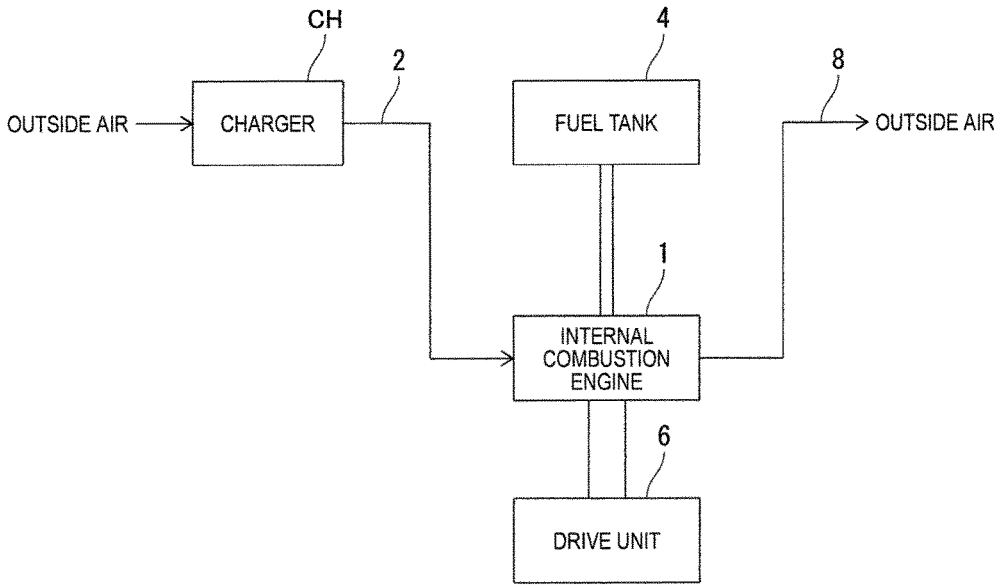
FIG. 1 is a block diagram illustrative of a schematic configuration of a vehicle including an internal combustion engine of a first embodiment of the present invention.

As illustrated in FIG. 1, the internal combustion engine 1 burns, in a combustion chamber (not illustrated), an air-fuel mixture into which air taken in from an intake pipe 2 to which a charger CH is connected and fuel supplied from the inside of a fuel tank 4 are mixed. Energy generated in the combustion of an air-fuel mixture is transmitted to a drive unit 6 including a transmission and the like. Furthermore, gas generated after combustion is exhausted from the combustion chamber to the outside via an exhaust pipe 8.

The charger CH pressurizes or accelerates air taken in from the outside air and supplies it to the intake pipe 2.

The types of the charger CH include an exhaust turbine driven type charger (turbocharger) or a mechanically driven type charger (supercharger).

(Configuration of Internal Combustion Engine 1)

Using FIGS. 2 to 6, while referring to FIG. 1, a configuration of the internal combustion engine 1 of the first embodiment will be described.

Figure 2:
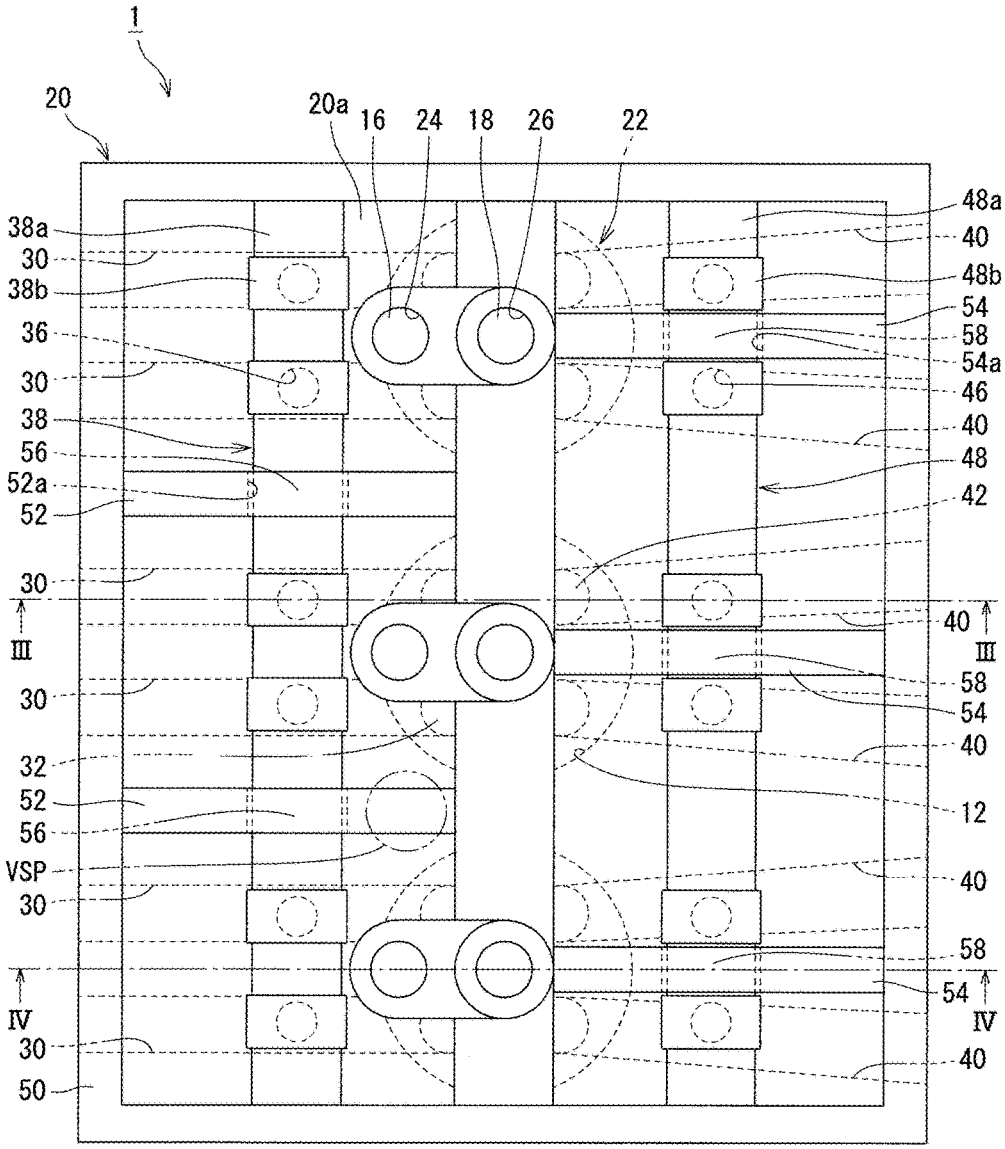
FIG. 2 is a plan view illustrative of a schematic configuration of the internal combustion engine of the first embodiment of the present invention.
Figure 3:
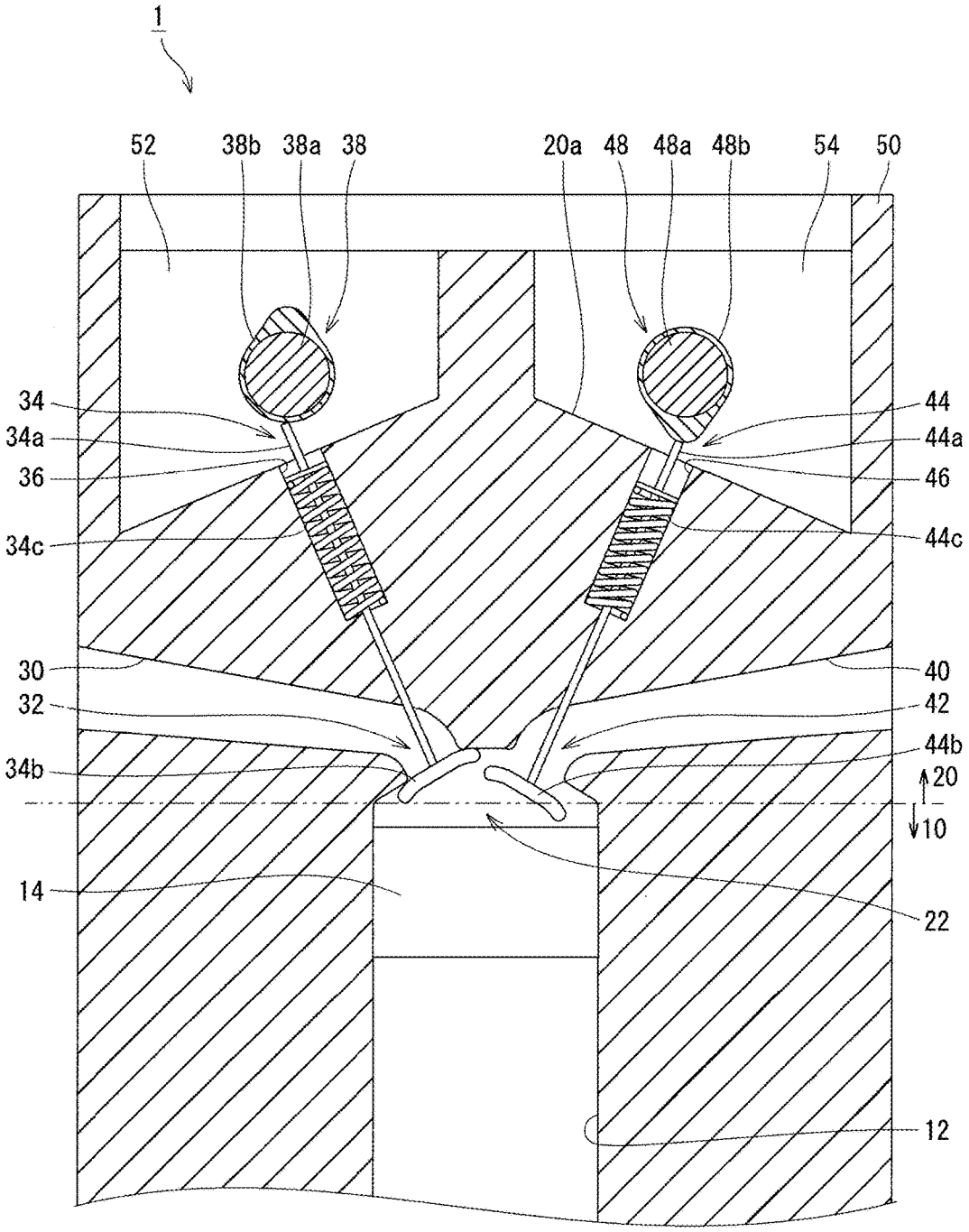
FIG. 3 is a cross sectional view taken along the line in FIG. 2.
Figure 4:
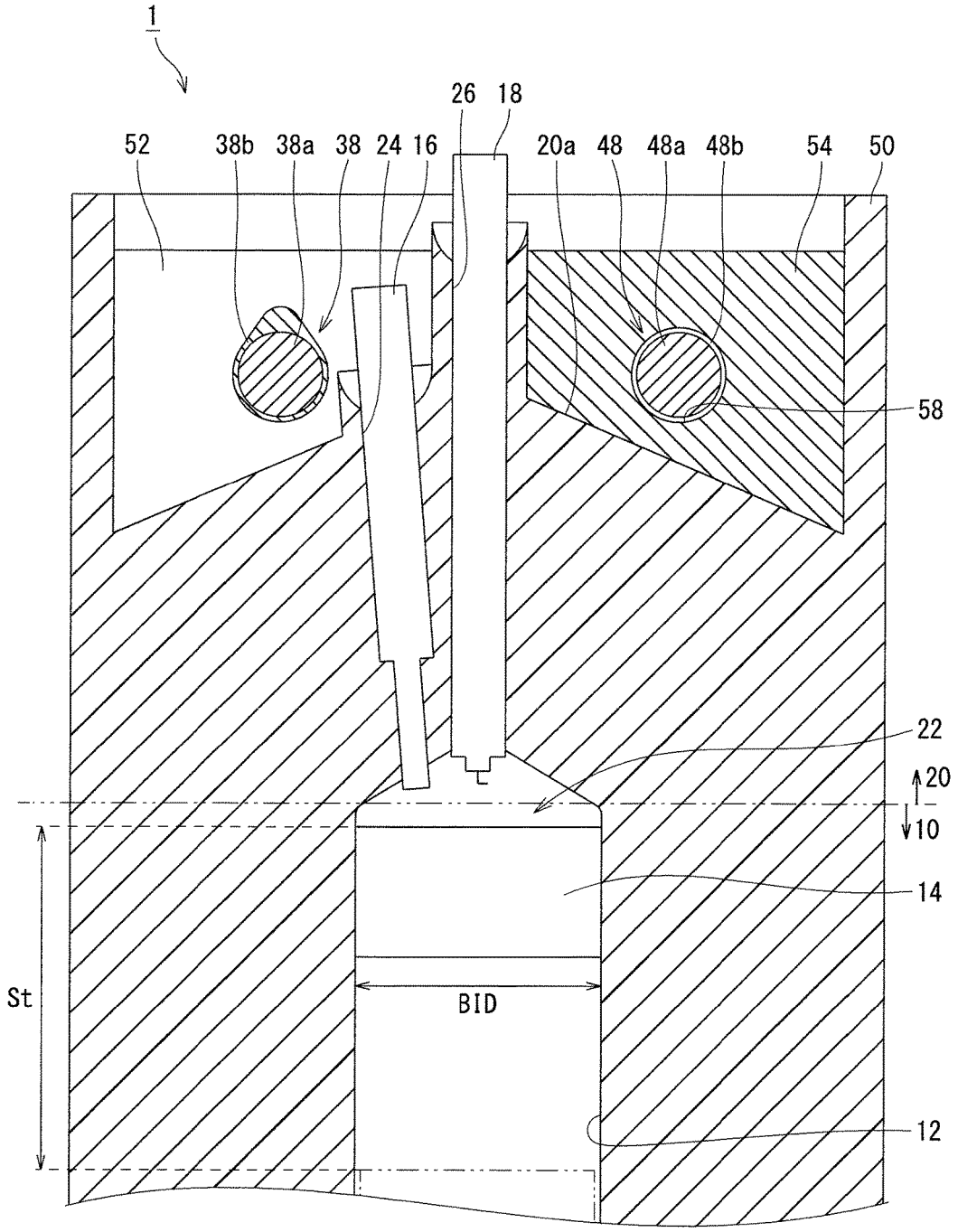
FIG. 4 is a cross sectional view taken along the line IV-IV in FIG. 2.

As illustrated in FIGS. 2 to 4, the internal combustion engine 1 includes a cylinder block 10 and a cylinder head 20.

The cylinder block 10 and the cylinder head 20 are, using a metal material such as an aluminum alloy, formed into one body, for example, by casting. In other words, the internal combustion engine 1 of the first embodiment has a structure in which the cylinder head 20 and the cylinder block 10 are formed into one body by casting (head-block integral structure).

Therefore, with regard to the internal combustion engine 1 of the first embodiment, the cylinder block 10 forms the lower portion of the internal combustion engine 1. In addition, with regard to the internal combustion engine 1 of the first embodiment, the cylinder head 20 forms the upper portion of the internal combustion engine 1.

In the cylinder block 10, a plurality of cylinders 12 are formed.

In the first embodiment, a case where three cylinders 12 are formed in the cylinder block 10 is described.

The respective cylinders 12 are arranged with the stroke directions of pistons 14 in the respective cylinders 12 directed in parallel with one another. In FIGS. 3 and 4, for purposes of description, the piston 14 is not illustrated in cross section.

Each piston 14 moves reciprocally in a cylinder 12 in the axial direction of the cylinder 12 in response to combustion of an air-fuel mixture inside a combustion chamber 22.

Each cylinder 12, in conjunction with a con rod (not illustrated) and a crankshaft (not illustrated), is formed in such a way that a stroke of a piston 14 is set to be not less than a bore inner diameter of the cylinder 12. In FIG. 4, the stroke of the piston 14 and the bore inner diameter of the cylinder 12 are indicated by a reference symbol "St" and a reference symbol "BID", respectively. Therefore, each cylinder 12 is formed into such a shape that the conditional expression (1) below holds.

$$St \geq \mathrm{BID} \quad (1)$$

In particular, in the first embodiment, each cylinder 12 is formed into such a shape that the conditional expression (2) below holds.

$$St > (\mathrm{BID} \times 1.2) \quad (2)$$

In other words, in the first embodiment, the stroke St of a piston 14 exceeds 1.2 times the bore inner diameter BID of a cylinder 12.

It is assumed that the shape of the cylinder head 20 is a shape that covers the upper ends of the respective cylinders 12. The above configuration causes the cylinder head 20, in conjunction with the cylinder block 10, to form a plurality of combustion chambers 22.

The plurality of combustion chambers 22 are arranged with the stroke directions of the pistons 14 inside the respective cylinders 12 directed in parallel with one another.

In the first embodiment, three cylinders 12 are formed in the cylinder block 10, as described above. Thus, a case where the cylinder head 20, in conjunction with the cylinder block 10, forms three combustion chambers 22 is described.

In other words, in the first embodiment, a case where the internal combustion engine 1 is configured as an internal combustion engine with three cylinders arranged in a straight line (straight 3-cylinder engine) is described.

The cylinder head 20 includes intake passages 30, exhaust passages 40, nozzle fitting holes 24, and plug fitting holes 26.

In addition to the above, on the cylinder head 20, an out frame 50, intake-side cam frames 52, and exhaust-side cam frames 54 are formed.

The intake passages 30 are passages that communicate the intake pipe 2 with the combustion chambers 22. The intake passages 30 are formed in the internal space of the cylinder head 20.

In the first embodiment, a case where one combustion chamber 22 is communicated with the intake pipe 2 by way of two intake passages 30 is described. Therefore, in the first embodiment, the cylinder head 20 includes six intake passages 30.

Two intake passages 30 that communicate one combustion chamber 22 with the intake pipe 2 are arranged along the direction in which the three cylinders 12 are arranged (in the vertical direction of the plane of illustration of FIG. 2). In addition, two intake passages 30 that communicate one combustion chamber 22 with the intake pipe 2 are formed with the length directions thereof directed in parallel with a radial direction of a cylinder 12 as viewed from the axial direction of the cylinder 12.

One open end of each intake passage 30 opens to the outer surface of the internal combustion engine 1 and communicates with the intake pipe 2. The other open end of the intake passage 30 opens to a combustion chambers 22 and communicates with the combustion chamber 22.

An intake valve 34 comes into contact with the opening of each intake passage 30 that opens to a combustion chamber 22. Therefore, the opening of the intake passage 30 that opens to the combustion chamber 22 forms an intake valve hole 32 that is opened and closed by the intake valve 34.

Each intake valve hole 32 opens at a portion of an intake passage 30 that forms an upper surface of a combustion chamber 22.

In the first embodiment, one combustion chamber 22 and the intake pipe 2 are communicated with each other by way of two intake passages 30. For this reason, in the first embodiment, two intake valve holes 32 are opened at portions of two intake passages 30 that form the upper surface of a combustion chamber 22. Therefore, in the first embodiment, the cylinder head 20 includes six intake valve holes 32.

In the first embodiment, all the intake valve holes 32 are formed into the same shape.

Two intake valve holes 32 that open to one combustion chamber 22 are arranged along the direction in which the three cylinders 12 are arranged.

Each intake valve 34 includes an intake valve stem 34*a* and an intake valve head 34*b*. In FIG. 3, for purposes of description, the intake valve stem 34*a* and the intake valve head 34*b* are not illustrated in cross section.

Each intake valve stem 34*a* is formed into a bar shape. One end of the intake valve stem 34*a* is configured to project out of an intake valve guide hole 36.

In addition, the intake valve stem 34*a* is supported to the cylinder head 20 via an intake valve spring 34*c*. In FIG. 3, for purposes of description, the intake valve spring 34*c* is not illustrated in cross section.

Each intake valve spring 34*c* is expandable and contractible in the axial direction of an intake valve stem 34*a* in response to rotation of an intake-side cam shaft 38, which will be described later. The intake valve spring 34*c* expands due to elastic force to bring an intake valve head 34*b* into contact with an intake valve hole 32 from the side where a combustion chamber 22 is located.

Each intake valve guide hole 36 is a through hole that is formed on an upper surface (upper deck) 20*a* of the cylinder head 20.

Each intake valve head 34*b* is formed into a shape (round shape) that enables an intake valve hole 32 to be closed. The intake valve head 34*b* is attached to the other end of an intake valve stem 34*a* and is disposed inside a combustion chamber 22.

The above configuration enables expansion of an intake valve spring 34*c* and contact of an intake valve head 34*b* with an intake valve hole 32 from the side where a combustion chamber 22 is located to cause the intake valve head 34*b* to close an intake passage 30.

The intake-side cam shaft 38 includes an intake-side shaft 38*a* and a plurality of intake-side cams 38*b*.

The intake-side shaft 38*a* is a cylindrical member. The intake-side shaft 38*a* is, with the axial direction thereof being parallel to the direction in which the three cylinders 12 are arranged, disposed at a position that causes the intake-side shaft 38*a* to overlap all the intake valve holes 32 as viewed in plan. Both ends of the intake-side shaft 38*a* are inserted into through holes (not illustrated) that are formed to the out frame 50.

Each intake-side cam 38*b* is disposed on the outer peripheral surface of the intake-side shaft 38*a*. In addition, each intake-side cam 38*b* is disposed at a position where the intake-side cam 38*b* overlaps an intake valve hole 32 as viewed in plan. Furthermore, each intake-side cam 38*b* is formed into an egg shape having a long radius and a short radius as viewed from the axial direction of the intake-side shaft 38*a*.

In the first embodiment, the cylinder block 10 and the cylinder head 20 form three combustion chambers 22, and each combustion chamber 22 is communicated with the intake pipe 2 by way of two intake passages 30. For this reason, in the first embodiment, the intake-side cam shaft 38 includes six intake-side cams 38*b*.

Pressing one end of each intake valve stem 34*a* by means of a long radius portion of an intake-side cam 38*b* causes the intake valve spring 34*c* to contract. The contraction of the intake valve spring 34*c* causes the intake valve head 34*b* to come off the intake valve hole 32 and to open an intake passage 30.

Consequently, the intake valves 34 are displaced in response to the rotation of the intake-side camshaft 38 to open and close the intake passages 30.

In the first embodiment, one combustion chamber 22 is communicated with the intake pipe 2 by way of two intake passages 30. For this reason, with respect to one combustion chamber 22, two intake valve holes 32 are formed. Therefore, in the first embodiment, with respect to one combustion chamber 22, two intake valve guide holes 36 are formed. The two intake valve guide holes 36 are arranged along the direction in which the three cylinders 12 are arranged.

The exhaust passages 40 are passages that communicate the exhaust pipe 8 with the combustion chambers 22. Each exhaust passage 40 is formed in a different space from the intake passages 30 in the internal space of the cylinder head 20.

In the first embodiment, a case where one combustion chamber 22 is communicated with the exhaust pipe 8 by way of two exhaust passages 40 is described. Therefore, in the first embodiment, the cylinder head 20 includes six exhaust passages 40.

Two exhaust passages 40 communicating one combustion chamber 22 with the exhaust pipe 8 are arranged along the direction in which the three cylinders 12 are arranged. In addition, two exhaust passages 40 that communicate one combustion chamber 22 with the exhaust pipe 8 are formed with the length directions thereof directed in parallel with a radial direction of a cylinder 12 as viewed from the axial direction of the cylinder 12.

One open end of each exhaust passage 40 opens to the outer surface of the internal combustion engine 1 and communicates with the exhaust pipe 8. The other open end of the exhaust passage 40 opens to a combustion chamber 22 and communicates with the combustion chamber 22.

An exhaust valve 44 comes into contact with the opening of each exhaust passage 40 that opens to a combustion chamber 22. Therefore, the opening of the exhaust passage 40 that opens to the combustion chamber 22 forms an exhaust valve hole 42 that is opened and closed by the exhaust valve 44.

Each exhaust valve hole 42 opens at a portion of an exhaust passage 40 that forms an upper surface of a combustion chamber 22 and is different from the respective intake valve holes 32.

In the first embodiment, one combustion chamber 22 is communicated with the exhaust pipe 8 by way of two exhaust passages 40. For this reason, two exhaust valve holes 42 are opened at portions of two exhaust passages 40 that form the upper surface of a combustion chamber 22. Therefore, in the first embodiment, the cylinder head 20 includes six exhaust valve holes 42.

In the first embodiment, all the exhaust valve holes 42 are formed into the same shape.

In addition, in the first embodiment, the exhaust valve holes 42 and the intake valve holes 32 are formed into such shapes that the conditional expression (3) below holds.

$$EXHvdi > INTvdi \quad (3)$$

In the conditional expression (3), "EXHvdi" and "INTvdi" indicate an inner diameter of an exhaust valve hole 42 and an inner diameter of an intake valve hole 32, respectively. Therefore, in the first embodiment, the opening area of an exhaust valve holes 42 is set to be larger than the opening area of an intake valve holes 32.

Figure 5:
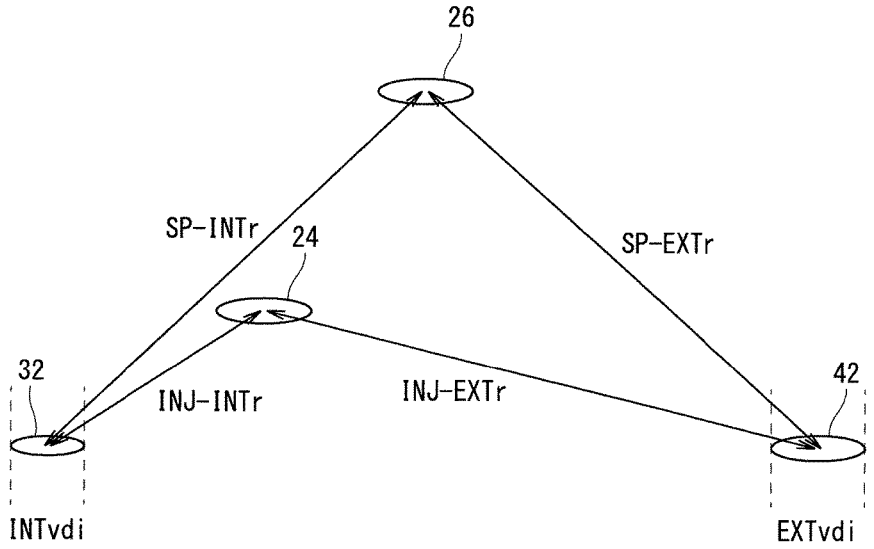
FIG. 5 is a conceptual diagram illustrative of positional relationships among a nozzle fitting hole, an exhaust valve hole, an intake valve hole, and a plug fitting hole that are formed to an identical combustion chamber.

In FIG. 5, for purposes of description, only four holes (an exhaust valve hole 42, an intake valve hole 32, a nozzle fitting hole 24, and a plug fitting hole 26) that are formed to one combustion chamber 22 are illustrated.

As described above, in the first embodiment, the cylinder head 20 includes six intake valve holes 32 and six exhaust valve holes 42. Furthermore, in the first embodiment, all the intake valve holes 32 are formed into the same shape. In addition to the above, in the first embodiment, all the exhaust valve holes 42 are formed into the same shape.

Therefore, in the first embodiment, the total value of opening areas of two exhaust valve holes 42 opening to one combustion chamber 22 is set to be larger than the total value of opening areas of two intake valve holes 32 opening to the one combustion chamber 22.

In addition, in the first embodiment, since the total value of opening areas of all the exhaust valve holes 42 is set to be larger than the total value of opening areas of all the intake valve holes 32, the conditional expression (4) below holds.

$$(EXHvdix6) > (INTvdix6) \quad (4)$$

Two exhaust valve holes 42 opening at a portion of an exhaust passage 40 that forms a roof of a combustion chamber 22 are arranged along the direction in which the three cylinders 12 are arranged.

Each exhaust valve 44 includes an exhaust valve stem 44*a* and an exhaust valve head 44*b*. In FIG. 3, for purposes of description, the exhaust valve stem 44*a* and the exhaust valve head 44*b* are not illustrated in cross section.

Each exhaust valve stem 44*a* is formed into a bar shape. One end of the exhaust valve stem 44*a* is configured to project out of an exhaust valve guide hole 46.

In addition, the exhaust valve stem 44*a* is supported to the cylinder head 20 via an exhaust valve spring 44*c*. In FIG. 3, for purposes of description, the exhaust valve spring 44*c* is not illustrated in cross section.

Each exhaust valve spring 44*c* is expandable and contractible in the axial direction of an exhaust valve stem 44*a* in response to rotation of an exhaust-side camshaft 48, which will be described later. The exhaust valve spring 44*c* expands due to elastic force to bring an exhaust valve head 44*b* into contact with an exhaust valve hole 42 from the side where a combustion chamber 22 is located.

Each exhaust valve guide hole 46 is a through hole that is formed on the upper surface 20*a* of the cylinder head 20.

Each exhaust valve head 44*b* is formed into a shape (round shape) that enables an exhaust valve hole 42 to be closed. The exhaust valve head 44*b* is attached to the other end of an exhaust valve stem 44*a* and is disposed inside a combustion chambers 22. The above configuration enables expansion of an exhaust valve spring 44*c* and contact of an exhaust valve head 44*b* with an exhaust valve hole 42 from the side where a combustion chamber 22 is located to cause the exhaust valve head 44*b* to close an exhaust passage 40.

As described above, in the first embodiment, the inner diameter EXHvdi of an exhaust valve hole 42 is set to be larger than the inner diameter INTvdi of an intake valve hole 32. Therefore, in the first embodiment, the outer diameter of an exhaust valve head 44*b* (the outer diameter of a portion coming into contact with an exhaust valve hole 42) is set to be larger than the outer diameter of an intake valve head 34*b* (the outer diameter of a portion coming into contact with an intake valve hole 32). In other words, the mass of an exhaust valve head 44*b* is set to be larger than the mass of an intake valve head 34*b*.

The exhaust-side cam shaft 48 includes an exhaust-side shaft 48*a* and a plurality of exhaust-side cams 48*b*.

The exhaust-side shaft 48*a* is a cylindrical member. The exhaust-side shaft 48*a* is, with the axial direction thereof being parallel to the direction in which the three cylinders 12 are arranged, disposed at a position that causes the exhaust-side shaft 48*a* to overlap all the exhaust valve holes 42 as viewed in plan. Both ends of the exhaust-side shaft 48*a* are inserted into through holes (not illustrated) that are formed to the out frame 50.

Each exhaust-side cam 48*b* is disposed on the outer peripheral surface of the exhaust-side shaft 48*a*. In addition, each exhaust-side cam 48*b* is disposed at a position where the exhaust-side cam 48*b* overlaps an exhaust valve hole 42 as viewed in plan. Furthermore, each exhaust-side cam 48*b* is formed into an egg shape having a long radius and a short radius as viewed from the axial direction of the exhaust-side shaft 48*a*.

In the first embodiment, the cylinder block 10 and the cylinder head 20 form three combustion chambers 22, and each combustion chamber 22 is communicated with the exhaust pipe 8 by way of two exhaust passages 40. For this reason, in the first embodiment, the exhaust-side cam shaft 48 includes six exhaust-side cams 48*b*.

Pressing one end of each exhaust valve stem 44*a* by means of a long radius portion of an exhaust-side cam 48*b* causes the exhaust valve spring 44*c* to contract. The contraction of the exhaust valve spring 44*c* causes the exhaust valve head 44*b* to come off the exhaust valve hole 42 and to open an exhaust passage 40.

Consequently, the exhaust valves 44 are displaced in response to the rotation of the exhaust-side cam shaft 48 to open and close the exhaust passages 40.

In the first embodiment, since one combustion chamber 22 is communicated with the exhaust pipe 8 by way of two exhaust passages 40, two exhaust valve holes 42 are formed with respect to one combustion chamber 22. Therefore, in the first embodiment, with respect to one combustion chamber 22, two exhaust valve guide holes 46 are formed. The two exhaust valve guide holes 46 are arranged along the direction in which the three cylinders 12 are arranged.

Each nozzle fitting hole 24 is a hole through which a fuel injection nozzle 16 is inserted into a combustion chambers 22. The nozzle fitting hole 24 is formed by a through hole that penetrates the upper surface 20*a* of the cylinder head 20. In FIG. 4, for purposes of description, the fuel injection nozzle 16 is not illustrated in cross section.

In the first embodiment, the cylinder head 20, in conjunction with the cylinder block 10, forms three combustion chambers 22. For this reason, the cylinder head 20 includes three nozzle fitting holes 24.

In addition, each nozzle fitting hole 24 is formed at such a position that the conditional expression (5) below holds.

$$\text{INJ-EXTr} > \text{INJ-INTr} \quad (5)$$

In the conditional expression (5), "INJ-EXTr" indicates a distance between the centers of a nozzle fitting hole 24 and an exhaust valve hole 42 that are formed to an identical combustion chamber 22. In the conditional expression (5), "INJ-INTr" indicates a distance between the centers of the nozzle fitting hole 24 and an intake valve hole 32 that are formed to the identical combustion chamber 22.

Therefore, in the first embodiment, the distance between a nozzle fitting hole 24 and an exhaust valve hole 42 is set to be longer than the distance between the nozzle fitting hole 24 and an intake valve hole 32.

Each fuel injection nozzle 16 is coupled to the fuel tank 4.

In addition, each fuel injection nozzle 16 is controlled by an ECU (Engine Control Unit) and the like to inject fuel (gasoline and the like) in the fuel tank 4 into a combustion chambers 22.

Each plug fitting hole 26 is a hole through which a spark plug 18 is inserted into a combustion chamber 22. The plug fitting hole 26 is formed penetrating the upper surface 20*a* of the cylinder head 20. In FIG. 4, for purposes of description, the spark plug 18 is not illustrated in cross section.

In the first embodiment, the cylinder head 20, in conjunction with the cylinder block 10, forms three combustion chambers 22. For this reason, the cylinder head 20 includes three plug fitting holes 26.

Each plug fitting hole 26 is formed at such a position that the conditional expression (6) below holds.

$$\text{SP-EXTr} \geq \text{SP-INTr} \quad (6)$$

In the conditional expression (6), "SP-EXTr" indicates a distance between the centers of a plug fitting hole 26 and an exhaust valve hole 42 that are formed to an identical combustion chamber 22. In the conditional expression (6), "SP-INTr" indicates a distance between the centers of the plug fitting hole 26 and an intake valve hole 32 that are formed to the identical combustion chamber 22.

Therefore, in the first embodiment, the distance between a plug fitting hole 26 and an exhaust valve hole 42 is set to be longer than the distance between the plug fitting hole 26 and an intake valve hole 32.

Each plug fitting hole 26 is disposed, as viewed from the axial direction of a cylinder 12, at the center of a combustion chamber 22 into which a spark plug 18 is inserted therethrough.

Each spark plug 18 is controlled by the ECU and the like to generate a spark inside a combustion chamber 22.

The out frame 50 is formed by combining four plate-shaped members into a frame shape and is disposed on the upper surface 20*a* of the cylinder head 20. The out frame 50 is formed into a shape enclosing the circumference of the cylinder head 20 as viewed in plan and forms an outer frame of the cylinder head 20.

Figure 6:
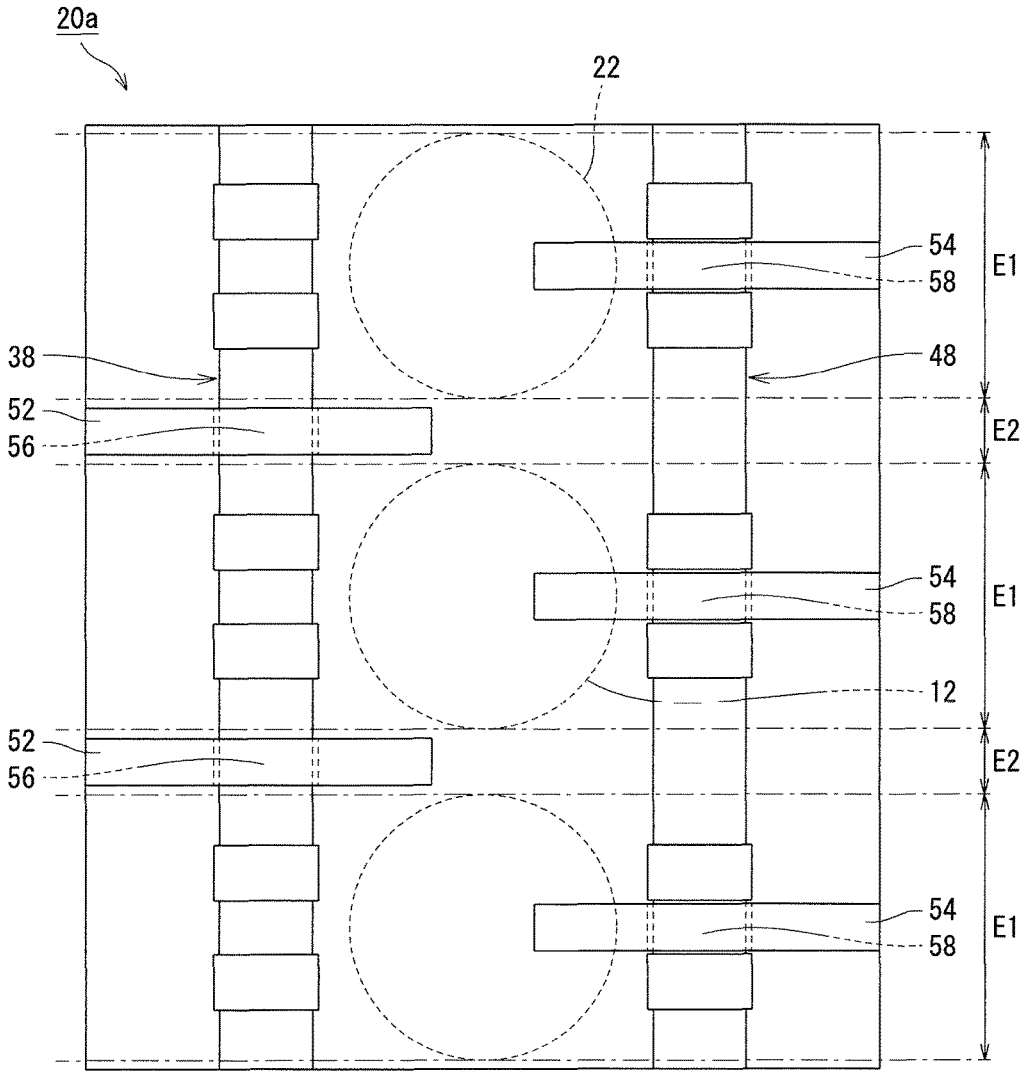
FIG. 6 is a conceptual diagram illustrative of a state in which an upper surface of a cylinder head is divided into first regions and second regions.

The upper surface 20*a* of the cylinder head 20 is now divided into first regions E1 and second regions E2, as illustrated in FIG. 6.

The first regions E1 are regions that are arranged along the direction in which the plurality of cylinders 12 are arranged and overlap the combustion chambers 22 as viewed form the axial direction of a cylinder 12.

The second regions E2 are regions each of which is arranged between two first regions E1 that are adjacent to each other.

In the first embodiment, the cylinder head 20, in conjunction with the cylinder block 10, forms three combustion chambers 22. For this reason, the upper surface 20*a* of the cylinder head 20 is divided into three first regions E1 and two second regions E2.

Each intake-side cam frame 52 is formed by a plate-shaped member and has side surfaces opposed to the upper surface 20*a* of the cylinder head 20 and the inner side surfaces of the out frame 50, respectively.

In the first embodiment, a case where two intake-side cam frames 52 are formed on the upper surface 20*a* of the cylinder head 20 is described.

To each intake-side cam frame 52, an intake-side frame through hole 52*a* is formed.

Each intake-side frame through hole 52*a* is a through hole that passes through an intake-side cam frame 52 in the thickness direction.

In addition, each intake-side frame through hole 52*a* is formed into a shape through which a portion of the intake-side shaft 38*a* at which no intake-side cam 38*b* is disposed can be inserted in a freely rotatable manner. The above configuration causes the inner wall surface of each intake-side frame through hole 52*a* to form an intake-side cam journal 56 that supports the intake-side cam shaft 38 in a rotatable manner.

In the first embodiment, a case where two intake-side cam frames 52 are formed on the upper surface 20*a* of the cylinder head 20 is described. Therefore, in the first embodiment, the cylinder head 20 includes two intake-side cam journals 56.

In the first embodiment, each of the two intake-side cam frames 52 is disposed in one of the second regions E2 of the upper surface 20*a* of the cylinder head 20.

Therefore, in the first embodiment, each of the two intake-side cam journals 56 is disposed in one of the second regions E2 of the upper surface 20*a* of the cylinder head 20.

Each exhaust-side cam frame 54 is formed by a plate-shaped member and has side surfaces opposed to the upper surface 20*a* of the cylinder head 20 and the inner side surfaces of the out frame 50, respectively.

The exhaust-side cam frames 54 are formed into the same shape as that of the intake-side cam frames 52.

In the first embodiment, a case where three exhaust-side cam frames 54 are formed on the upper surface 20*a* of the cylinder head 20 is described.

To each exhaust-side cam frame 54, an exhaust-side frame through hole 54*a* is formed.

Each exhaust-side frame through hole 54*a* is a through hole that passes through an exhaust-side cam frame 54 in the thickness direction.

In addition, each exhaust-side frame through hole 54*a* is formed into a shape through which a portion of the exhaust-side shaft 48*a* at which no exhaust-side cam 48*b* is disposed can be inserted in a freely rotatable manner. The above configuration causes the inner wall surface of each exhaust-side frame through hole 54*a* to form an exhaust-side cam journal 58 that supports the exhaust-side cam shaft 48 in a rotatable manner.

In the first embodiment, a case where three exhaust-side cam frames 54 are formed on the upper surface 20*a* of the cylinder head 20 is described. In other words, in the first embodiment, the cylinder head 20 includes three exhaust-side cam journals 58.

Therefore, in the first embodiment, the intake-side cam frames 52 and the exhaust-side cam frames 54 are formed into the same shape, and, furthermore, one more exhaust-side cam frame 54 than the number of intake-side cam frames 52 is formed on the upper surface 20*a* of the cylinder head 20.

In the first embodiment, each of the three exhaust-side cam frames 54 is disposed in one of the first regions E1 of the upper surface 20*a* of the cylinder head 20.

Therefore, in the first embodiment, each of the three exhaust-side cam journals 58 is disposed in one of the first regions E1 of the upper surface 20*a* of the cylinder head 20.

(Regarding Position of Intake-Side Cam Frame 52)

With reference to FIGS. 1 to 6, the reason for disposing the intake-side cam frames 52 in the second regions E2 of the upper surface 20*a* of the cylinder head 20 will be described.

On an internal combustion engine with a head-block separation structure, each intake-side cam frame 52 is disposed, as viewed from the axial direction of a cylinder 12, between two intake valve holes 32 that are formed for one combustion chamber 22 in the upper surface 20*a* of the cylinder head 20. In other words, on an internal combustion engine with the head-block separation structure, the intake-side cam frames 52 are disposed in the first regions E1 of the upper surface 20*a* of the cylinder head 20.

The head-block separation structure is a structure in which the cylinder head 20 and the cylinder block 10 are formed by casting separately. The cylinder head 20 and the cylinder block 10 are subsequently joined to each other using cylinder head bolts. In FIG. 2, for purposes of description, a virtual securing position of a cylinder head bolt on an internal combustion engine with the head-block separation structure is indicated by assigning a reference symbol "VSP".

The reason for disposing the intake-side cam frames 52 in the first regions E1 of the upper surface 20*a* of the cylinder head 20 on the internal combustion engine with the head-block separation structure is as follows.

On the internal combustion engine with the head-block separation structure, a position where a cylinder head bolt is secured is, restricted by strength and the like that an internal combustion engine is required to have, located between intake valve holes 32 formed separately for combustion chambers 22 adjacent to each other in the upper surface 20*a* of the cylinder head 20.

The internal combustion engine 1 of the first embodiment has a head-block integral structure and does not require a cylinder head bolt. Therefore, in the first embodiment, to the cylinder head 20 and the cylinder block 10, neither opening nor space for insertion of a cylinder head bolt is formed.

For this reason, in the first embodiment, an intake-side cam frame 52 can be disposed at a position where a cylinder head bolt would be disposed if the internal combustion engine 1 had the head-block separation structure.

(Regarding Position of Nozzle Fitting Hole 24)

With reference to FIGS. 1 to 5, the reason for forming each nozzle fitting hole 24 at such a position that the conditional expression (5) holds will be described.

As described above, on an internal combustion engine with the head-block separation structure, each intake-side cam frame 52 is disposed, as viewed from the axial direction of a cylinder 12, between two intake valve holes 32 that are formed for one combustion chamber 22 in the upper surface 20*a* of the cylinder head 20. For this reason, on the internal combustion engine with the head-block separation structure, each nozzle fitting hole 24 is required to be formed on the top of a combustion chamber 22 (top injection structure).

This is because the intake-side cam frames 52 are disposed on the side of the combustion chambers 22 where the intake pipe 2 is located, which makes it difficult to secure spaces for disposing the fuel injection nozzles 16. Similarly, this is because, on the side of the combustion chambers 22 where the exhaust pipe 8 is located, the exhaust-side cam frames 54 are disposed, which makes it difficult to secure spaces for disposing the fuel injection nozzles 16.

On the internal combustion engine 1 of the first embodiment, as described above, the intake-side cam frames 52 can be disposed at positions where cylinder head bolts would be disposed if the internal combustion engine 1 had the head-block separation structure.

The above feature enables the internal combustion engine 1 of the first embodiment to secure spaces for disposing the fuel injection nozzles 16 on the side of the combustion chambers 22 where the intake pipe 2 is located. Therefore, in the first embodiment, it becomes possible to form each nozzle fitting hole 24 at such a position that the conditional expression (5) holds.

(Regarding Position of Plug Fitting Hole 26)

With reference to FIGS. 1 to 6, the reason for forming each plug fitting hole 26 at such a position that the conditional expression (6) holds will be described.

As described above, on an internal combustion engine with the head-block separation structure, each nozzle fitting hole 24 is formed on the top of a combustion chamber 22. For this reason, on the internal combustion engine with the head-block separation structure, each plug fitting hole 26 is formed on the side of a combustion chamber 22 where the exhaust pipe 8 is located. This is because interference between a spark plug 18 and a fuel injection nozzle 16 is to be avoided.

On the internal combustion engine 1 of the first embodiment, as described above, spaces for disposing the fuel injection nozzles 16 can be secured on the side of the combustion chambers 22 where the intake pipe 2 is located. Therefore, in the first embodiment, it becomes possible to form each plug fitting hole 26 at such a position that the conditional expression (6) holds.

(Regarding Opening Area of Exhaust Valve Hole 42 and Opening Area of Intake Valve Hole 32)

With reference to FIGS. 1 to 6, the reason for setting the opening area of an exhaust valve holes 42 to be larger than the opening area of an intake valve holes 32 will be described.

As described above, on an internal combustion engine with the head-block separation structure, each intake-side cam frame 52 is disposed, as viewed from the axial direction of a cylinder 12, between two intake valve holes 32 that are formed for one combustion chamber 22 in the upper surface 20*a* of the cylinder head 20. In addition to the above, on the internal combustion engine with the head-block separation structure, each exhaust-side cam frame 54 is disposed, as viewed from the axial direction of a cylinder 12, between two exhaust valve holes 42 that are formed for one combustion chamber 22 in the upper surface 20*a* of the cylinder head 20.

This is because a position where a cylinder head bolt is secured is restricted to, in the upper surface 20*a* of the cylinder head 20, a position between pairs of two exhaust valve holes 42 formed for one combustion chamber 22 because of required strength and the like.

On the internal combustion engine 1 of the first embodiment, as described above, spaces for disposing the fuel injection nozzles 16 can be secured on the side of the combustion chambers 22 where the intake pipe 2 is located. In addition to the above, on the internal combustion engine 1 of the first embodiment, each plug fitting holes 26 can be formed at such a position that the conditional expression (5) holds. In the first embodiment, the above feature enables a space margin to be secured on the side of the combustion chambers 22 where the exhaust pipe 8 is located more easily than on the side of the combustion chambers 22 where the intake pipe 2 is located.

Therefore, in the first embodiment, it becomes possible to set the opening area of an exhaust valve holes 42 to be larger than the opening area of an intake valve holes 32.

(Operation)

With reference to FIGS. 1 to 6, an example of an operation performed using the internal combustion engine 1 of the first embodiment will be described.

When the internal combustion engine 1 is operating, such as while a vehicle is in use, air taken in from the intake pipe 2 and fuel injected through the nozzle fitting holes 24 into the combustion chambers 22 are mixed in the combustion chambers 22. Air-fuel mixtures mixed in the combustion chambers 22 are ignited by sparks generated by the spark plugs 18 and are burned in the combustion chambers 22. The above operation causes energy generated by combustion of the air-fuel mixtures to be transmitted to the drive unit 6 and gas after combustion to be exhausted to the outside via the exhaust pipe 8.

In the first embodiment, the charger CH is connected to the intake pipe 2. Thus, when an amount of air taken in from the intake pipe 2 into the combustion chambers 22 (intake amount) is to be increased in acceleration of the vehicle and the like, the intake amount is forcibly increased by the charger CH. The above operation causes filling efficiency of air supplied into the combustion chambers 22 to be increased.

Regarding the internal combustion engine 1 of the first embodiment, the opening area of an exhaust valve holes 42 is larger than the opening area of an intake valve holes 32.

For this reason, it becomes possible to set an amount of air (exhaust) that is able to pass the exhaust valve holes 42 per unit time to be larger than an amount of air (intake) that is able to pass the intake valve holes 32 per unit time.

Even when the intake amount is increased by the charger CH, the above configuration enables a reduction in a ratio of the exhaust amount to the intake amount to be suppressed and an increase in the intake amount by the charger CH to be offset.

Therefore, in the first embodiment, it becomes possible to, with respect to the internal combustion engine 1, suppress a reduction in exhaust efficiency to suppress a reduction in combustion efficiency.

It should be noted that the first embodiment mentioned above is one example of the present invention, the present invention is not limited to the first embodiment mentioned above, and, even when the present invention may be carried out in modes other than the embodiment, depending on designs, various changes may be made to the present invention within a scope not departing from the technical idea of the present invention.

(Advantageous Effects of First Embodiment)

The internal combustion engine 1 according to the first embodiment enables advantageous effects described below to be attained.

(1) The opening area of an exhaust valve holes 42 is set to be larger than the opening area of an intake valve holes 32.

This feature enables an exhaust amount per unit time to be set to be greater than an intake amount per unit time.

As a consequence, even when the intake amount is increased by the charger CH, it becomes possible to suppress a reduction in a ratio of the exhaust amount to the intake amount to offset an increase in the intake amount by the charger CH.

The above configuration enables the internal combustion engine 1 to suppress a reduction in exhaust efficiency to suppress a reduction in combustion efficiency. For this reason, it becomes possible to improve torque and output power that the internal combustion engine 1 generates.

(2) The stroke St of each piston 14 is set to be not less than the bore inner diameter BID of each cylinder 12.

As a consequence, compared with an internal combustion engine 1 having the same exhaust amount and including cylinders 12 each of which has a stroke St less than a bore inner diameter BID, it becomes possible to maintain speed-up of the pistons 14 and, in conjunction therewith, to improve exhaust efficiency.

(3) The distance INJ-EXTr between a nozzle fitting hole 24 and an exhaust valve hole 42 is set to be longer than the distance INJ-INTr between the nozzle fitting hole 24 and an intake valve hole 32.

This feature enables the positions of the nozzle fitting holes 24 to be located on the intake side of the internal combustion engine 1 rather than the exhaust side. The above configuration enables the fuel injection nozzles 16 to be disposed on the intake side where the temperature is lower than the exhaust side.

As a consequence, it becomes possible to reduce a deposit (carbon deposit) produced on the fuel injection nozzles 16.

(4) The distance SP-EXTr between a plug fitting hole 26 and an exhaust valve hole 42 is set to be not shorter than the distance SP-INTr between the plug fitting hole 26 and an intake valve hole 32.

As a consequence, it becomes possible to locate the positions of the plug fitting holes 26 at positions located on the intake side between the exhaust side and the intake side of the internal combustion engine 1. In other words, the degree of freedom in designing positions where the spark plugs 18 are to be disposed has been improved.

(5) Each plug fitting hole 26 is disposed at the center of a combustion chamber 22.

This feature enables sparks that the spark plugs 18 generate to be generated at the centers of the combustion chambers 22. The above configuration enables combustion performance of air-fuel mixtures in the combustion chambers 22 to be improved.

As a consequence, it becomes possible to improve torque and output power that the internal combustion engine 1 generates.

(6) The total value of the opening areas of a plurality of exhaust valve holes 42 opening to one combustion chamber 22 is set to be larger than the total value of the opening areas of a plurality of intake valve holes 32 opening to the one combustion chamber 22.

This feature enables, even when the intake amount is increased by the charger CH, a reduction in a ratio of the exhaust amount to the intake amount to be suppressed and an increase in the intake amount by the charger CH to be offset.

As a consequence, with respect to the internal combustion engine 1, it becomes possible to suppress a reduction in exhaust efficiency to suppress a reduction in combustion efficiency. For this reason, it becomes possible to improve torque and output power that the internal combustion engine 1 generates.

(7) To the cylinder block 10, a plurality of cylinders 12 that are arranged with the stroke directions of the pistons 14 directed in parallel with one another are formed. In addition, the cylinder head 20 and the cylinder block 10 that are formed into one body by casting form a plurality of combustion chambers 22 that are arranged with the stroke directions of the pistons 14 directed in parallel with one another.

Furthermore, the upper surface 20*a* of the cylinder head 20 is divided, along the direction in which the plurality of cylinders 12 are arrange, into the first regions E1 that overlap the combustion chambers 22 as viewed from the axial direction of a cylinder 12 and the second regions E2 each of which is arranged between two first regions E1 adjacent to each other. In addition to the above, the intake-side cam journals 56 are disposed in the second regions E2 of the upper surface 20*a* of the cylinder head 20.

The above configuration enables, without increasing the distance between the intake-side cam frames 52, the positions of the intake-side cam journals 56 to be shifted from, as viewed from the axial direction of a cylinder 12, positions each between two intake valve holes 32 formed for one combustion chamber 22.

As a consequence, it becomes possible to improve a degree of freedom in designing the cylinder head 20, such as determining layouts of the nozzle fitting holes 24 and the plug fitting holes 26 and shapes, dimensions, and the like of the exhaust valve holes 42 and the intake valve holes 32.

In addition, positions where the intake-side cam journals 56 are disposed are not influenced by positions where cylinder head bolts would be secured if the internal combustion engine 1 had the head-block separation structure.

Since the above configuration enables the degree of freedom in designing the cylinder head 20 and the cylinder block 10 to be improved, it becomes possible to improve the degree of freedom in designing the internal combustion engine 1.

(8) The intake-side cam journals 56 are disposed in the second regions E2 of the upper surface 20*a* of the cylinder head 20.

This feature enables, without increasing the distance between the intake-side cam frames 52, the positions of the intake-side cam journals 56 to be shifted from, as viewed from the axial direction of a cylinder 12, positions each between two intake valve holes 32 formed for one combustion chamber 22.

As a consequence, compared with an internal combustion engine 1 with a configuration in which the positions of the intake-side cam journals 56 are shifted by increasing the distance between the intake-side cam frames 52, it becomes possible to suppress an increase in the size and weight of the internal combustion engine 1.

(9) The intake-side cam journals 56 are disposed in the second regions E2 of the upper surface 20*a* of the cylinder head 20.

This feature enables distances between the intake-side cam frames 52 and the plug fitting holes 26 to be increased compared with a case in which each intake-side cam journal 56 is disposed between two intake valve holes 32 formed for one combustion chamber 22.

As a consequence, compared with a case in which each intake-side cam journal 56 is disposed between two intake valve holes 32 formed for one combustion chamber 22, it becomes possible to suppress deformations of the intake-side cam journals 56 due to the influence from heat generated by the spark plugs 18.

(10) The masses of the exhaust valve heads 44*b* are set to be larger than the masses of the intake valve heads 34*b*.

The intake-side cam frames 52 and the exhaust-side cam frames 54 are formed into the same shape. In addition to the above, the exhaust-side cam shaft 48 is supported in a rotatable manner by more exhaust-side cam journals 58 than intake-side cam journals 56.

These features enable the exhaust-side cam shaft 48 that, in response to rotation thereof, displaces the exhaust valves 44 with larger masses than the intake valves 34 to be supported in a rotatable manner by more exhaust-side cam journals 58 than intake-side cam journals 56.

As a consequence, the exhaust-side cam shaft 48 that is required to have more strength than the intake-side cam shaft 38 is supported by more exhaust-side cam journals 58 than intake-side cam journals 56, and which enables a load imposed on the exhaust-side cam journals 58 to be distributed. The above configuration enables durability of the exhaust-side cam frames 54 to be increased. In addition, it becomes possible to improve stability in supporting the exhaust-side cam shaft 48.

(Variations)

(1) Although, in the first embodiment, the intake-side cam journals 56 were disposed in the second regions E2 of the upper surface 20*a* of the cylinder head 20, the present invention is not limited to the configuration.

Figure 7:
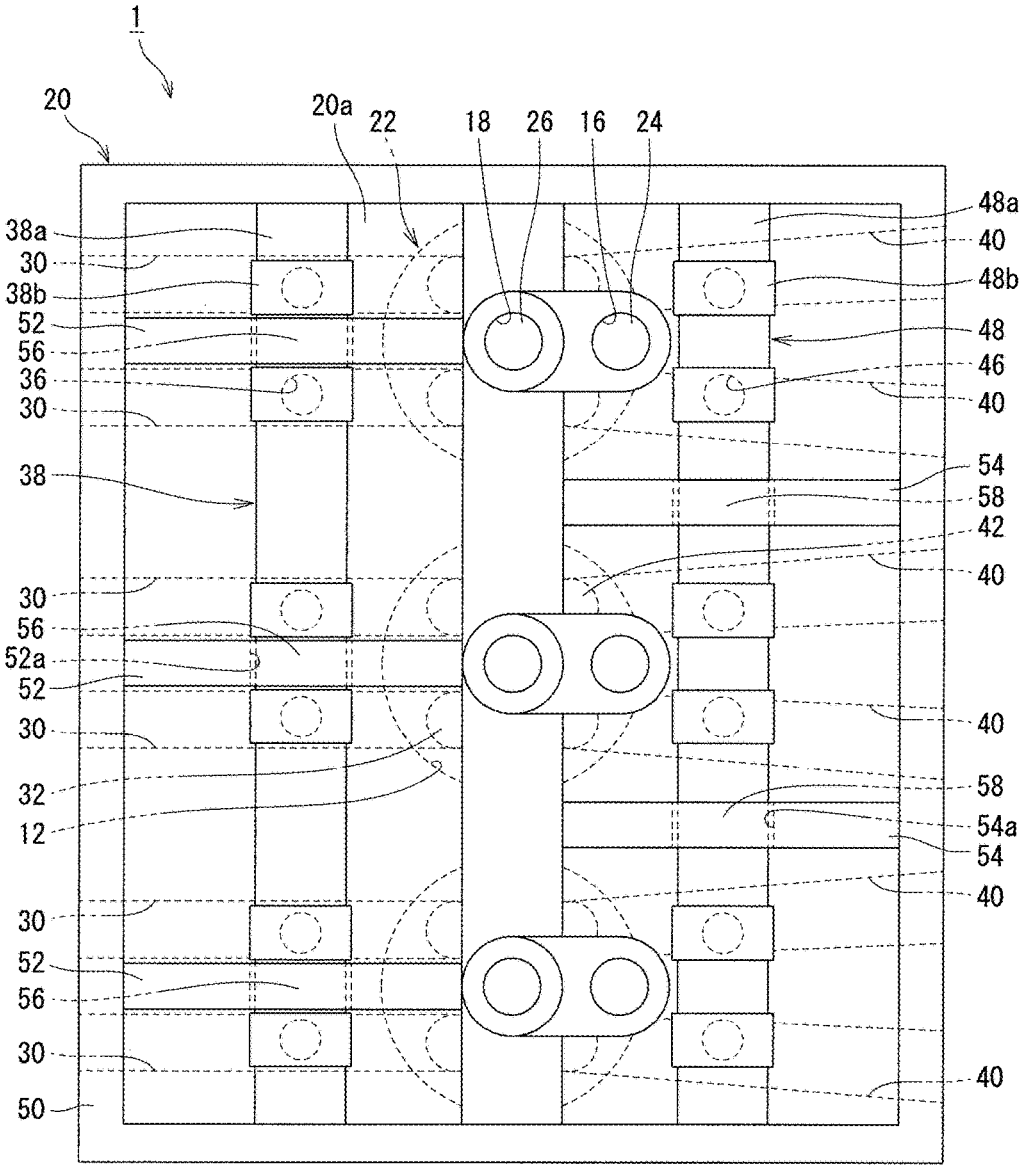
FIG. 7 is a diagram illustrative of a variation of the first embodiment of the present invention.

In other words, as illustrated in FIG. 7, the exhaust-side cam journals 58 may be disposed in the second regions E2 of the upper surface 20*a* of the cylinder head 20.

In this case, it becomes possible to, without increasing the distances between the exhaust-side cam frames 54, shift the positions of the exhaust-side cam journals 58 from, as viewed from the axial direction of a cylinder 12, positions each between two exhaust valve holes 42 formed for one combustion chamber 22.

The above configuration enables the degree of freedom in designing the cylinder head 20, such as determining layouts of the nozzle fitting holes 24 and the plug fitting holes 26 and shapes, dimensions, and the like of the exhaust valve holes 42 and the intake valve holes 32, to be improved.

Therefore, in the present invention, positions where the exhaust-side cam journals 58 are disposed are not influenced by positions where cylinder head bolts would be secured if the internal combustion engine 1 had the head-block separation structure.

Since the above configuration enables the degree of freedom in designing the cylinder head 20 and the cylinder block 10 to be improved, it becomes possible to improve the degree of freedom in designing the internal combustion engine 1.

When the configuration of the internal combustion engine 1 is the configuration illustrated in FIG. 7, the inner diameter EXHvdi of the exhaust valve holes 42 may be set to be less than the inner diameter INTvdi of the intake valve holes 32, differing from the first embodiment.

(2) Although, in the first embodiment, the intake-side cam journals 56 were disposed in the second regions E2 of the upper surface 20*a* of the cylinder head 20, the present invention is not limited to the configuration.

Figure 8:
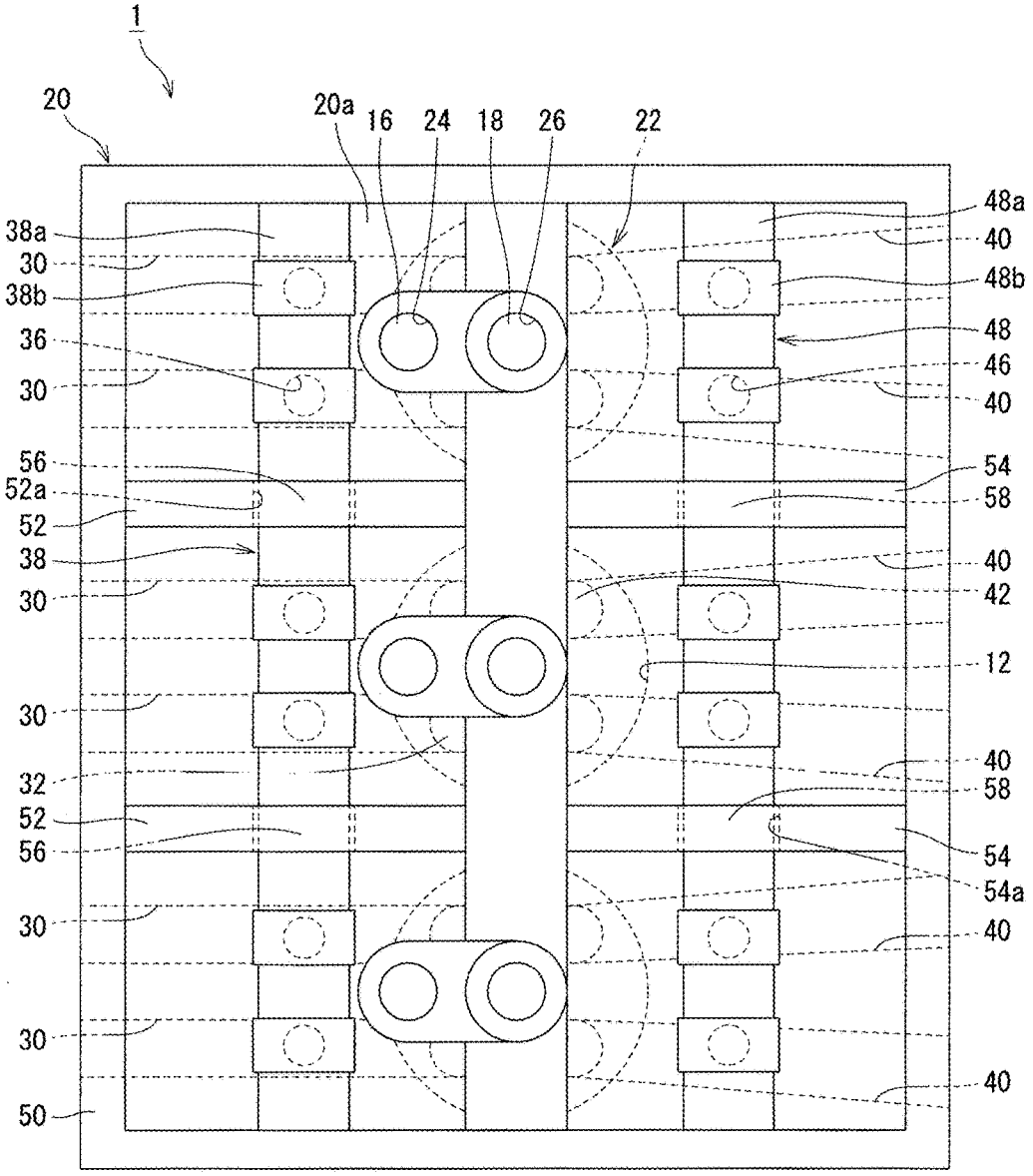
FIG. 8 is a diagram illustrative of another variation of the first embodiment of the present invention.

In other words, as illustrated in FIG. 8, the intake-side cam journals 56 and the exhaust-side cam journals 58 may be disposed in the second regions E2 of the upper surface 20*a* of the cylinder head 20.

In this case, it becomes possible to, without increasing the distance between the intake-side cam frames 52, shift the positions of the intake-side cam journals 56 from, as viewed from the axial direction of a cylinder 12, positions each between two intake valve holes 32 formed for one combustion chamber 22. In addition to the above, it becomes possible to, without increasing the distances between the exhaust-side cam frames 54, shift the positions of the exhaust-side cam journals 58 from, as viewed from the axial direction of a cylinder 12, positions each between two exhaust valve holes 42 formed for one combustion chamber 22.

The above configuration enables the degree of freedom in designing the cylinder head 20, such as determining layouts of the nozzle fitting holes 24 and the plug fitting holes 26 and shapes, dimensions, and the like of the exhaust valve holes 42 and the intake valve holes 32, to be improved.

Therefore, in the present invention, positions where the intake-side cam journals 56 and the exhaust-side cam journals 58 are disposed are not influenced by positions where cylinder head bolts would be secured if the internal combustion engine 1 had the head-block separation structure.

Since the above configuration enables the degree of freedom in designing the cylinder head 20 and the cylinder block 10 to be improved, it becomes possible to improve the degree of freedom in designing the internal combustion engine 1.

When the configuration of the internal combustion engine 1 is the configuration illustrated in FIG. 8, the inner diameter EXHvdi of the exhaust valve holes 42 and the inner diameter INTvdi of the intake valve holes 32 may be set at the same value, differing from the first embodiment.

(3) Although, in the first embodiment, the configuration of the internal combustion engine 1 was a configuration in which air-fuel mixtures in the combustion chambers 22 are ignited by sparks generated by the spark plugs 18 (gasoline engine), the present invention is not limited to the configuration.

Figure 9:
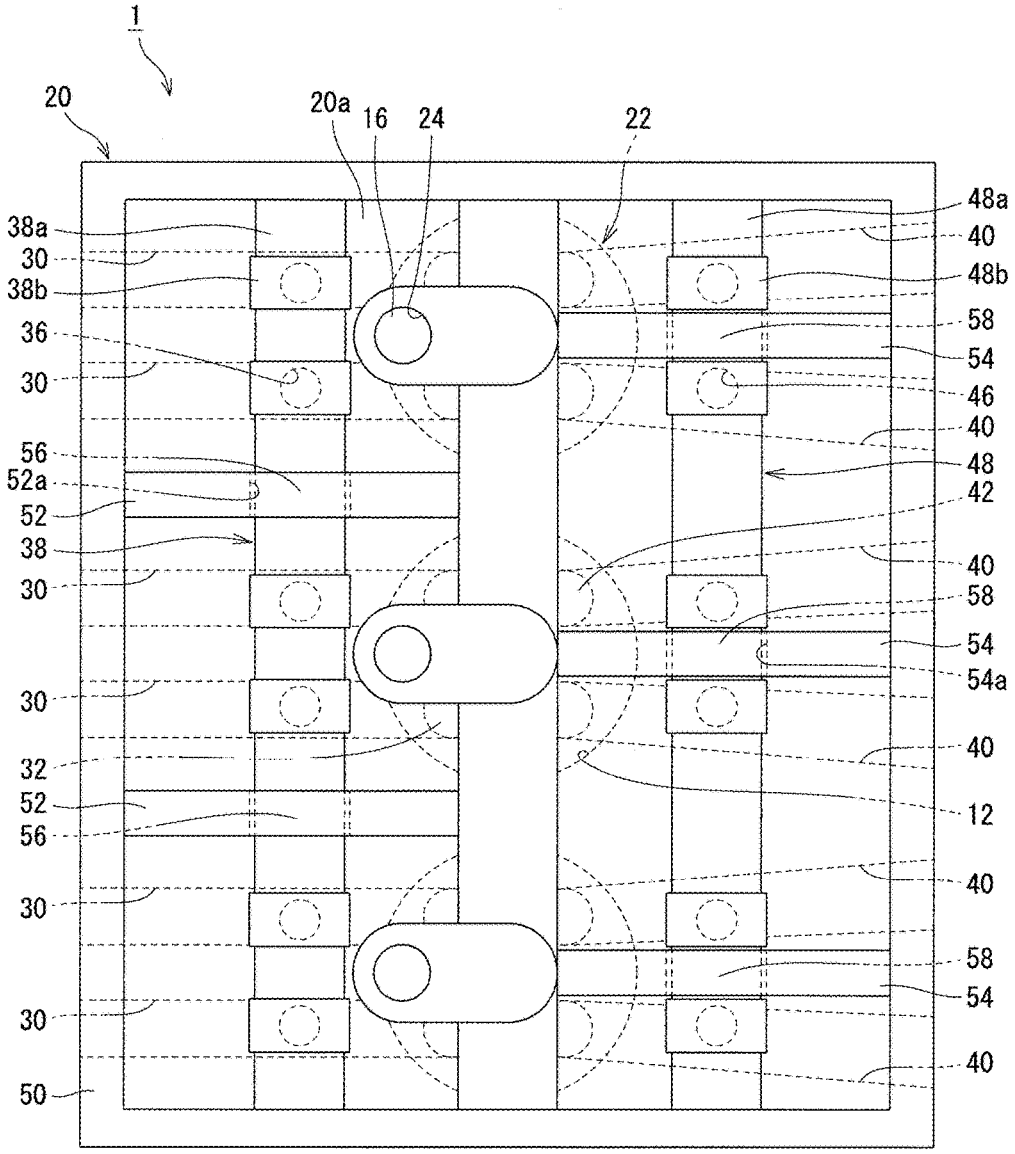
FIG. 9 is a diagram illustrative of still another variation of the first embodiment of the present invention.

In other words, the configuration of the internal combustion engine 1 may be a configuration in which air-fuel mixtures in the combustion chambers 22 are ignited without using a spark plug 18 (diesel engine). In this case, the configuration of the internal combustion engine 1 becomes, for example, a configuration in which the cylinder head 20 does not include any plug fitting hole, as illustrated in FIG. 9.

(4) Although, in the first embodiment, the configuration of the internal combustion engine 1 was an internal combustion engine with three cylinders arranged in a straight line (straight 3-cylinder engine), the present invention is not limited to the configuration.

In other words, the internal combustion engine 1 may be configured as an internal combustion engine of V-type (V-type engine) or an internal combustion engine of horizontally opposed type (horizontally opposed engine).

(5) Although, in the first embodiment, the configuration of the intake pipe 2 was a configuration in which the charger CH is connected thereto, the present invention is not limited to the configuration.

In other words, the configuration of the intake pipe 2 may be a configuration in which no charger is connected (natural intake: Natural Aspiration or Normal Aspiration).

REFERENCE SIGNS LIST

1 Internal combustion engine
2 Intake pipe
4 Fuel tank
6 Drive unit
8 Exhaust pipe
10 Cylinder block
12 Cylinder
14 Piston
16 Fuel injection nozzle
18 Spark plug
20 Cylinder head
20*a* Upper surface of the cylinder head
22 Combustion chamber
24 Nozzle fitting hole
26 Plug fitting hole
30 Intake passage
32 Intake valve hole
34 Intake valve
34*a* Intake valve stem
34*b* Intake valve head
34*c* Intake valve spring
36 Intake valve guide hole
38 Intake-side cam shaft
38*a* Intake-side shaft
38*b* Intake-side cam
40 Exhaust passage
42 Exhaust valve hole
44 Exhaust valve
44*a* Exhaust valve stem
44*b* Exhaust valve head
44*c* Exhaust valve spring
46 Exhaust valve guide hole
48 Exhaust-side cam shaft
48*a* Exhaust-side shaft
48*b* Exhaust-side cam
50 Out frame
52 Intake-side cam frame
52*a* Intake-side frame through hole
54 Exhaust-side cam frame
54*a* Exhaust-side frame through hole
56 Intake-side cam journal
58 Exhaust-side cam journal
CH Charger
St Stroke of piston
BID Bore inner diameter of a cylinder
EXHvdi Inside diameter of an exhaust valve hole
INTvdi Inside diameter of an intake valve hole
INJ-EXTr Distance between the center of a nozzle fitting hole and the center of an exhaust valve hole
INJ-INTr Distance between the center of a nozzle fitting hole and the center of an intake valve hole
SP-EXTr Distance between the center of a plug fitting hole and the center of an exhaust valve hole
SP-INTr Distance between the center of a plug fitting hole and the center of an intake valve hole
E1 First region
E2 Second region
VSP Virtual securing position of a cylinder head bolt

The invention claimed is:

1. An internal combustion engine comprising:

a cylinder block in which a plurality of cylinders are formed; and a cylinder head that forms a plurality of combustion chambers in conjunction with the cylinder block, wherein the cylinder block and the cylinder head are formed into one body, the cylinder head includes: a plurality of intake passages each of which communicates an intake pipe with one of the plurality of combustion chambers; a plurality of exhaust passages each of which communicates an exhaust pipe with one of the plurality of combustion chambers; an intake-side cam journal that supports, in a rotatable manner, an intake-side cam shaft that displaces intake valves that open and close the intake passages; and an exhaust-side cam journal that supports, in a rotatable manner, an exhaust-side cam shaft that displaces exhaust valves that open and close the exhaust passages, an upper surface of the cylinder head is divided, along a direction in which the plurality of cylinders are arranged, into first regions that are regions that overlap the combustion chambers as viewed from an axial direction of the cylinders and a second region that is a region located between two of the first regions adjacent to each other, at least either the intake-side cam journal or the exhaust-side cam journal is disposed in the second region, and an opening area of an exhaust valve hole that is an opening of the exhaust passage opening to the combustion chamber is set to be larger than an opening area of an intake valve hole that is an opening of the intake passage opening to the combustion chamber.

2. The internal combustion engine according to claim 1, wherein the intake-side cam journal is disposed in the second region, and the exhaust-side cam journal is disposed in the first regions.

3. The internal combustion engine according to claim 1, wherein the intake-side cam journal is disposed in the first regions, and the exhaust-side cam journal is disposed in the second region.

4. The internal combustion engine according to claim 1, wherein the intake-side cam journal and the exhaust-side cam journal are disposed in the second region.

5. The internal combustion engine according to claim 1, wherein the cylinder head further includes nozzle fitting holes through which fuel injection nozzles are inserted into the combustion chambers, and a distance between each of the nozzle fitting holes and one of exhaust valve holes that are openings of the exhaust passages opening to the combustion chambers is set to be longer than a distance between the nozzle fitting hole and one of intake valve holes that are openings of the intake passages opening to the combustion chambers.

6. The internal combustion engine according to claim 1, wherein the cylinder head further includes plug fitting holes through which spark plugs are inserted into the combustion chambers, and a distance between each of the plug fitting holes and one of exhaust valve holes that are openings of the exhaust passages opening to the combustion chambers is set to be not shorter than a distance between the plug fitting hole and one of intake valve holes that are openings of the intake passages opening to the combustion chambers.

7. The internal combustion engine according to claim 1, wherein the cylinder head further includes plug fitting holes through which spark plugs are inserted into the combustion chambers, and each of the plug fitting holes is disposed at a center of one of the combustion chambers.

* * * * *